US009538823B2

(12) United States Patent
Hayes et al.

(10) Patent No.: US 9,538,823 B2
(45) Date of Patent: Jan. 10, 2017

(54) BATHTUB BABY RINSER

(71) Applicant: SKIP HOP, INC., New York, NY (US)

(72) Inventors: Adam L. Hayes, Brooklyn, NY (US); Janet Villano, Jersey City, NJ (US); Ellen Diamant, New York, NY (US); Jeffrey E. Butler, Jr., Hawthorne, NY (US)

(73) Assignee: SKIP HOP, INC., New York, NY (US)

( * ) Notice: Subject to any disclaimer, the term of this patent is extended or adjusted under 35 U.S.C. 154(b) by 0 days.

(21) Appl. No.: 14/260,018

(22) Filed: Apr. 23, 2014

(65) Prior Publication Data

US 2015/0305470 A1 Oct. 29, 2015

(51) Int. Cl.

*A45D 19/06* (2006.01)
*A45D 19/02* (2006.01)
*A45D 19/00* (2006.01)

(52) U.S. Cl.

CPC ..... *A45D 19/02* (2013.01); *A45D 19/00* (2013.01); *A45D 19/06* (2013.01); *A45D 2019/0058* (2013.01)

(58) Field of Classification Search

CPC A45D 19/02; A45D 19/06; A45D 2019/0058; A45D 19/00
USPC ..... 222/465.1, 572, 210, 564; 604/78
See application file for complete search history.

(56) References Cited

U.S. PATENT DOCUMENTS

| | | | | |
|---|---|---|---|---|
| 677,950 | A | 7/1901 | Cutter | |
| 2,334,779 | A | 11/1943 | Luft | |
| D143,517 | S | 8/1945 | Whitlock | |
| 2,511,560 | A * | 6/1950 | Bechmann | 239/652 |
| D174,298 | S | 3/1955 | Timmons | |
| 2,919,694 | A * | 1/1960 | Von Gunten | B65D 1/265 215/386 |
| 3,063,190 | A | 11/1962 | Adelson | |
| 3,810,470 | A * | 5/1974 | Von Gunten | A61J 7/0046 206/515 |
| 3,965,496 | A | 6/1976 | Grelle | |
| 5,054,661 | A * | 10/1991 | Hollje | 222/465.1 |
| D337,629 | S | 7/1993 | Lal | |
| 5,443,184 | A * | 8/1995 | Broitzman | 222/189.07 |
| 5,960,987 | A * | 10/1999 | Solland et al. | 220/834 |
| D424,158 | S | 5/2000 | Besecke | |
| 6,427,879 | B1 * | 8/2002 | Caldwell | 222/465.1 |
| 6,902,060 | B2 | 6/2005 | Michelson et al. | |
| 7,404,229 | B2 | 7/2008 | Monahan et al. | |
| 7,441,675 | B2 | 10/2008 | McGinley et al. | |
| 7,736,090 | B2 | 6/2010 | Janesky | |

(Continued)

FOREIGN PATENT DOCUMENTS

JP H09-37984 2/1997

OTHER PUBLICATIONS

European Search Report dated Aug. 28, 2015 in corresponding EP Application No. 15 16 4915.

*Primary Examiner* — Kevin P Shaver
*Assistant Examiner* — Robert Nichols, II
(74) *Attorney, Agent, or Firm* — Stephen J. Weyer, Esq.; Stites & Harbison, PLLC.

(57) ABSTRACT

A container has a body with an opening for holding a fluid such as water. A plurality of substantially parallel fins extend from an opening toward an opposite end of the container defining parallel channels. When a fluid is dispersed from the opening of the container, the fluid is dispersed evenly across the opening in a coaxial direction to the fins.

19 Claims, 4 Drawing Sheets

(56) References Cited

U.S. PATENT DOCUMENTS

| | | | | |
|---|---|---|---|---|
| 7,757,895 | B2 | 7/2010 | McGinley et al. | |
| D622,784 | S | 8/2010 | Cohen | |
| 7,908,683 | B1 | 3/2011 | Finell | |
| D635,641 | S | 4/2011 | Freese | |
| 7,958,680 | B2 | 6/2011 | Denooy | |
| 8,087,595 | B1 | 1/2012 | Freese | |
| D670,771 | S | 11/2012 | Lo et al. | |
| 8,636,178 | B2 | 1/2014 | McGinley et al. | |
| 8,714,417 | B1 * | 5/2014 | Szekely | 222/572 |
| D722,824 | S * | 2/2015 | Albert | D7/509 |
| 2004/0149783 | A1 | 8/2004 | McGinley | |
| 2004/0155070 | A1 | 8/2004 | McGinley et al. | |
| 2009/0032551 | A1 | 2/2009 | McGinley et al. | |
| 2009/0045229 | A1 | 2/2009 | McGinley et al. | |
| 2010/0175134 | A1 * | 7/2010 | Ali-Ahmad et al. | 726/24 |
| 2013/0033959 | A1 | 2/2013 | Conti | |

* cited by examiner

BATHTUB BABY RINSER

FIELD OF INVENTION

The present invention relates to a container and in particular a container for holding liquid so that the liquid can be dispensed from the container in a controlled manner.

BACKGROUND OF THE INVENTION

Many different containers are used to hold and dispense liquids or fluids. Some containers have handles for grasping the container and spouts for controlled pouring of the contents from the container. Examples of such containers include pitchers such as ones for dispensing beverages into a glass or cup. Beverage pitchers are well-suited for dispensing a liquid into a glass as these containers focus the flow of the beverage to a relatively narrow stream.

Conventional containers such as pitchers are not well-suited to dispense a broad, wide flow of liquid. Typically, the spout or edge of the pitcher's mouth will concentrate the liquid in a narrow stream and thus not provide a broad flow of fluid. Therefore, conventional pitchers are not well-suited for use to rinse shampoo or soap when giving an infant a bath. Likewise, conventional pitchers are not ideal for rinsing soap or shampoo from your pet during its bath.

One recent pitcher in U.S. Patent Application Publication No. 2009/045229 has a flexible panel with a broad bottom surface shown in its FIG. 7. The pitcher dispenses water over a broader area. The publication describes various forms including one in its FIG. 8 in which bottom interior surface has ridges 52 for concentrating the flow of a liquid to the center.

What is needed in the art is an improved container for rinsing an infant which more evenly dispenses liquid from the container over a wider area.

SUMMARY OF THE INVENTION

The present invention relates to a container for use during infant baths which provides for a steady flow of water to be dispensed. The container could also be used when giving a pet a bath. The container has a series of parallel fins that channel water into a steady broad flow as the water is dispensed from the container.

The present invention in one form relates to a container comprising a body having a hollow interior. The body has an opening on one end and an opposite rear portion. A plurality of substantially parallel fins extend upward from an interior bottom surface of the body. The fins extend longitudinally from the opening toward the rear portion of the body defining substantially parallel channels extending from the opening toward the rear portion of the body. When a fluid is dispensed from the container, the fluid is evenly dispersed across the opening in a coaxial direction to the fins.

Advantageously, when fluid such as water is dispensed from the opening of the container, there is minimal lateral dispersment of the fluid from the container relative to the longitudinal direction of fins.

In one further embodiment, the container has a lip portion extending from the opening of the body, adjacent the bottom interior. Advantageously, the lip portion is formed from an elastomeric or rubber material. The elastomeric or rubber material allows the lip to fit snugly or tightly to the forehead of an infant to thereby prevent water, soap or shampoo from getting in the eyes of the infant when pouring liquid from the container, e.g. during rinsing.

The invention, in another form thereof, relates to a body comprising a semi-cylindrical portion extending from a wider end to a tapered end and a bottom portion extending from the wider opening toward the tapered opening of the semi-cylindrical portion. The semi-cylindrical portion joined with the bottom portion to define a fluid tight vessel having a hollow interior. The body has an opening at the wider end of the semi-cylindrical portion and an opposite, a closed end, at a location where the tapered end of the semi-cylindrical portion and the bottom portion meet. A plurality of substantially parallel fins extend upward from an interior surface of the bottom portion. The fins extend longitudinally from the opening toward the closed end of the body defining substantially parallel channels extending from the opening toward the closed end of the body. When a fluid is dispensed from the opening of the body, the fluid is dispersed evenly across the opening in a coaxially direction to the fins.

BRIEF DESCRIPTION OF THE DRAWINGS

The present invention will now be described with regard to the drawings as follows.

FIGS. 3*a* and 3*b* are perspective views of the container demonstrating how the container can be used to dispense a liquid in accordance with the present invention in which FIG. 3*a* shows orientation of the container when being filled with water and FIG. 3*b* showing orientation of the container when pouring the water from the container.

DETAILED DESCRIPTION

Figure 1:
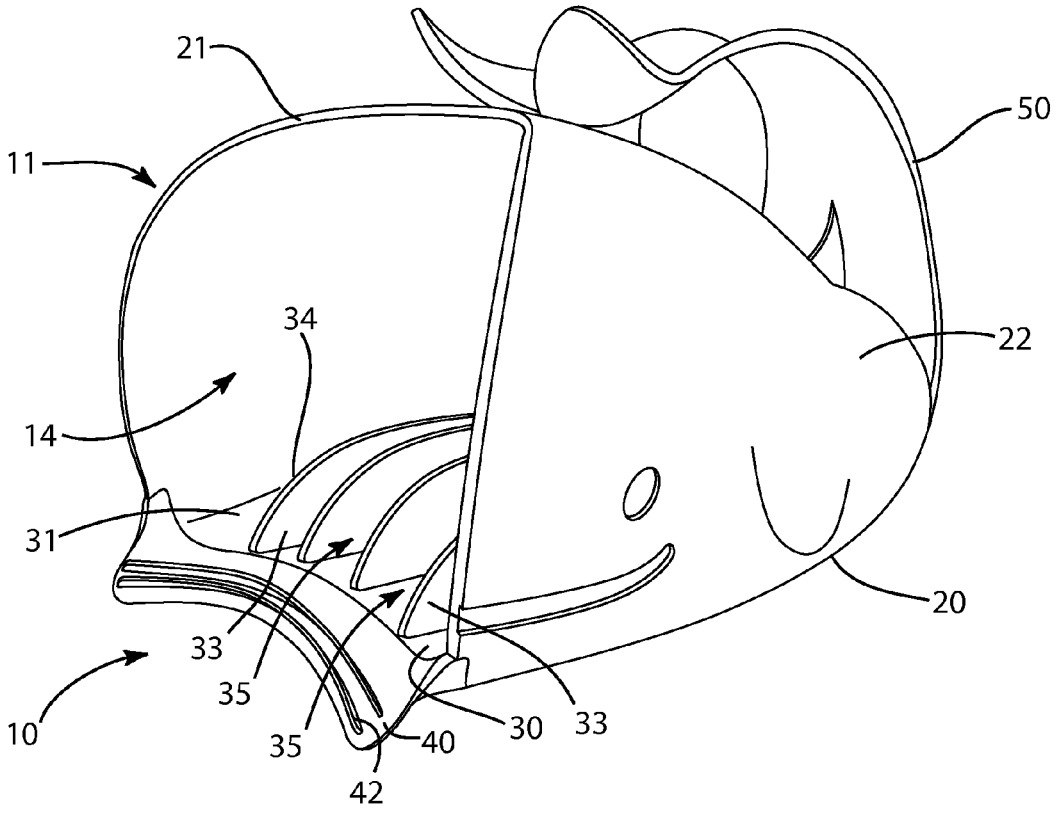
FIG. 1 is a perspective view of a container in accordance with the present invention.
Figure 2:
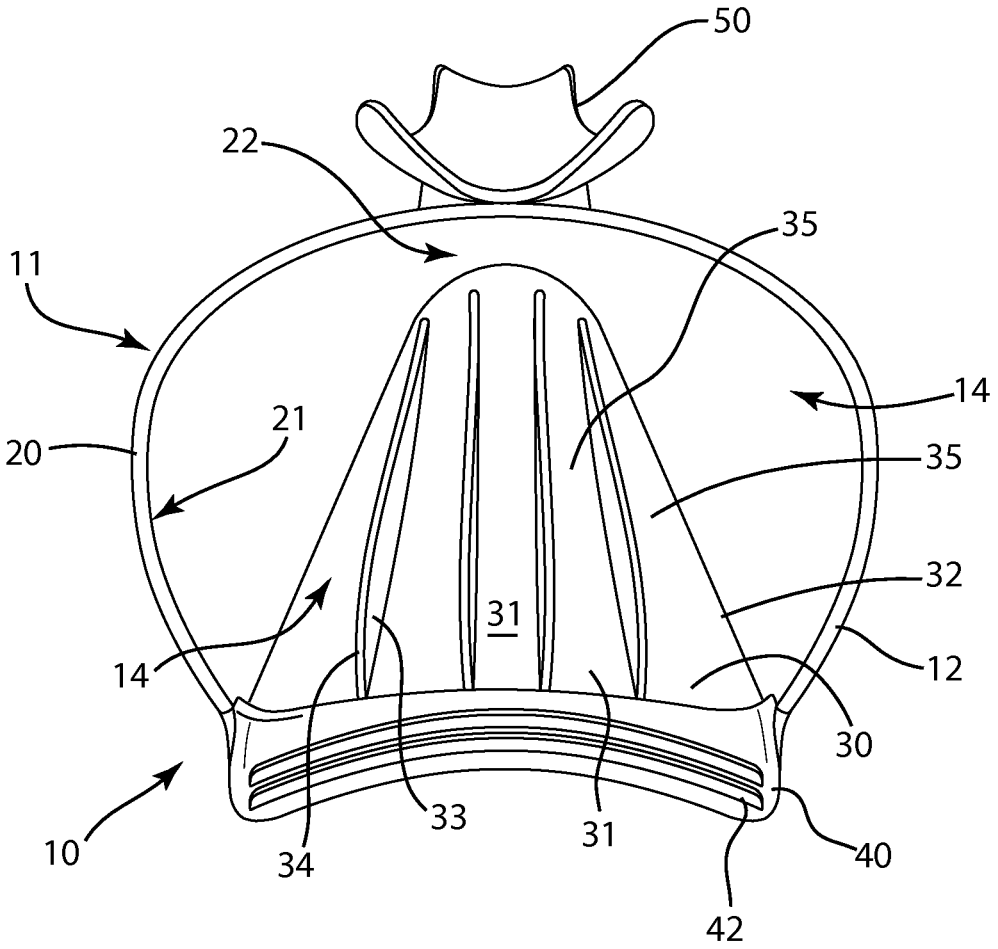
FIG. 2 is a front elevational view of the container of FIG. 1.

The present container will now be described with reference to the drawings and in particular FIGS. 1 and 2. Container 10 includes a body portion 12 which comprises U-shaped portion 20 and bottom portion 30. The U-shaped portion 20 has a semi-cylindrical shape and forms the side and top of the body 12 and the bottom portion 30 forms the remaining side of the body 12. The U-shaped semi-cylindrical portion 20 mates with the bottom portion 30 along line 32. Together, the U-shaped portion 20 and bottom portion 30 define a hollow interior 14 of a fluid tight vessel.

The U-shaped semi-cylindrical portion 20 has a wide end 21 at the opening 11 of the container 10 and a tapered end 22 opposite the opening 11 of the container. Advantageously, the U-shaped semi-cylindrical portion 20 and the bottom portion 30 are formed as a single molded piece of material. Alternatively, the two separate portions 20, 30 can be formed separately and joined together to form the body 12.

A plurality of parallel fins 33 extend upward from bottom surface 31 of the bottom portion 32. The fins 31 have a tapered end 34 the fins 33 extend longitudinally from the opening toward the opposite end of the container 10, i.e. toward the tapered end of the U-shaped semi-cylindrical portion 20. The plurality of fins 31 define substantially parallel channels 35. The bottom surface 31 is slightly concave inward toward the hollow interior 14. The fins 33 extend gently upward from the bottom surface 31 at the tapered end 34.

A lip 40, formed of a rubber or an elastomeric material, is attached to the bottom portion 30 adjacent the opening 11. The rubber or elastomeric material of lip 40 allows for a snug or tight fit between the container 10 and head of an infant when pressed together. This seal/tight engagement limits or prevents water, shampoo or soap from inadvertently flowing into an infant's eyes when water is dispersed from container 10. A series of ridges 42 provide sufficient rigidity and tolerance of adjustability to the lip 40 to allow for a good seal between the container 10 and an infant's head.

A handle 50 is attached to the tapered end 22 of the U-shaped semi-cylindrical portion 20 and the wide end 21. The handle 50 allows one to hold the container 10 in one hand and a baby or infant in the other. Further, since the handle 50 spans between the entire length of the U-shaped body 12, the handle 50 provides more stability than if the handle were only attached to the opening end 21 or the tapered end 22 of the container 10.

Figure 3A:
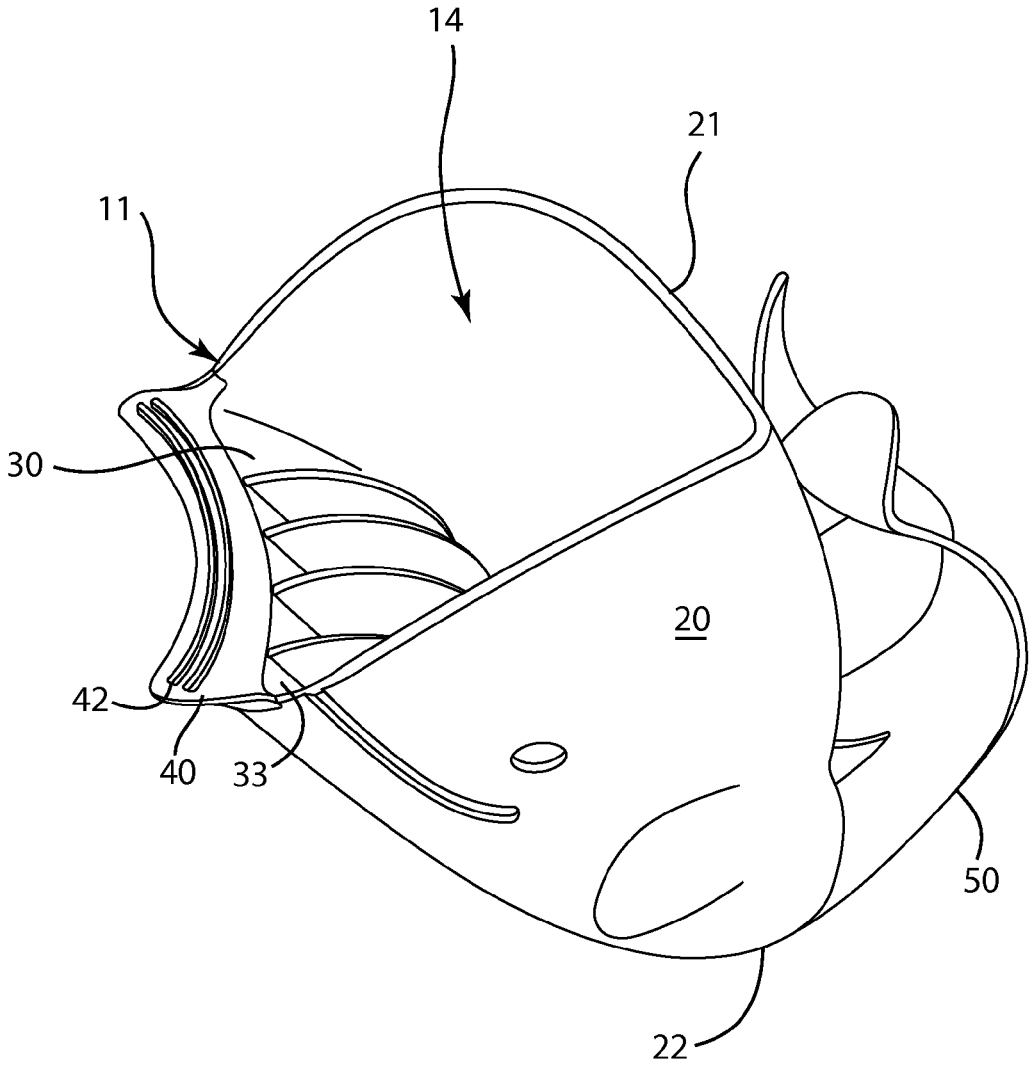
Figure 3B:
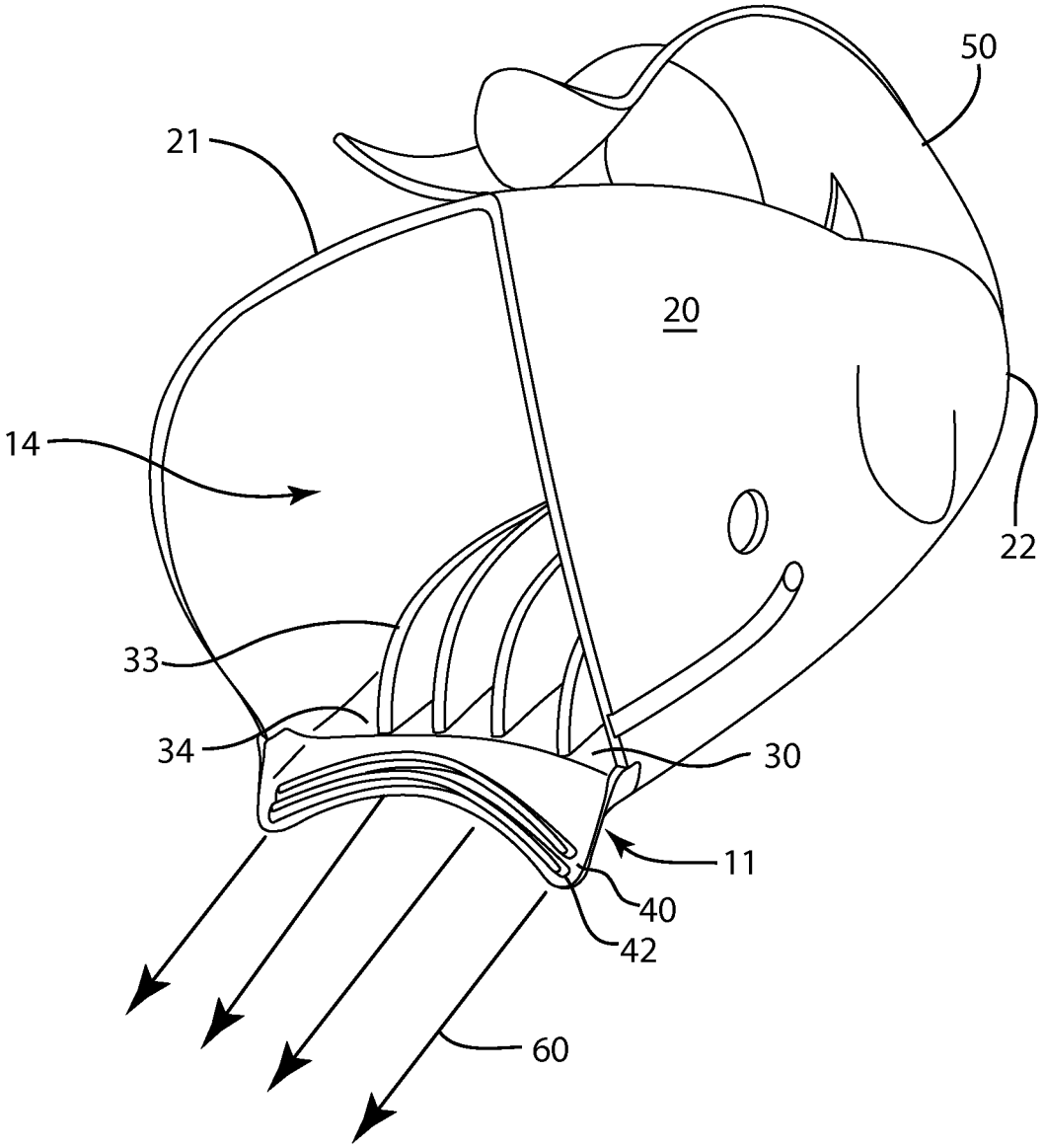

Container 10 can be used as a baby bath rinser by filing the hollow interior 14 with water. Referring now to FIGS. 3*a* and 3*b*, during use, one fills the hollow interior space 14 of the container 10 with water by holding the container 10 as shown in FIG. 3*a*, with the opening upward. Tilting the container 10 downward as shown in FIG. 3*b* allows the water to be dispersed from the container 10 out the opening 11 as indicated by the arrows 60. The fins 33 direct the water to flow evenly across the opening 11 adjacent the bottom portion 30, in a coaxial direction to the fins 33. The water is spread evenly across the lip 40 and is not dispersed outward in a direction diagonal or transverse to the longitudinal direction of fins 33 (i.e. the direction of arrows 60) or concentrate inward. As a result, a steady flow of water is dispensed from the container 10 across the entire opening.

It now will be clear that the present container 10 has features and advantages not found in other prior know containers. The shape of the container defined by the body 12 and parallel fins 33 provide for a steady flow of water to be dispensed from the container 10. Further, due to the shape of the bottom portion 30 in conjunction with the fins 33, the water is dispensed over a wide surface area. Accordingly, the flow of water will be relatively even over the entire length of the opening 11 along the bottom portion 30 rather than being concentrated toward the center of the bottom portion or diverted outward towards the edges of the bottom portion 30 adjacent the U-shaped semi-cylindrical portion where the bottom portion meets the U-shaped semi-cylindrical portion. In addition, the relatively more rigid body 12 allows the container 10 to be sufficiently firm to hold the water while the separate less rigid rubber or elastomeric lip 40 allow the container 10 to be snugly fit to an infant's forehead to thereby prevent water from getting in the infant's eyes.

One of ordinary skill in the art will recognize that additional embodiments are also possible without departing from the teachings of the presently-disclosed subject matter. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and can be made without departing from the spirit and scope of the presently-disclosed subject matter.

What is claimed is:

1. A container, said container comprising:

a body having a hollow interior defining an enclosed cavity for retaining a fluid, the body has a top opening and a closed bottom, opposite the top, the cavity having a side which extends from the opening to the bottom of the cavity; and a plurality of substantially parallel fins, each fin extending upwardly from an interior side surface of the body, the fins extending longitudinally from the opening to the bottom of the body, along substantially an entire length of the interior side surface of the body from the opening to the bottom, defining substantially parallel channels extending from the opening to the bottom of the body, each fin being disposed parallel to a flow of fluid when a fluid is dispensed from the cavity and out the opening, wherein when a fluid is dispensed from the opening of the body, the fluid is dispersed evenly across the opening in a coaxial direction to the fins.

2. The container of claim 1, wherein the fluid is dispensed from the opening with minimal lateral dispersion relative the longitudinal direction of the fins.

3. The container of claim 1, the interior side surface is concave.

4. The container of claim 1, further comprises a lip portion extending from a portion of the opening of the body, adjacent the interior side surface interior, the lip portion formed from an elastomeric or rubber material.

5. The container of claim 4, wherein the elastomeric or rubber material is softer than the material which composes the body.

6. The container of claim 1, further comprising a handle attached to an exterior surface of the body.

7. The container of claim 6, wherein the handle is attached to an exterior surface near the bottom portion of the body.

8. The container of claim 1, wherein the fins extend gradually upward from the interior side surface at a tapered end of the fins proximate the opening of the body.

9. The container of claim 1, further comprising a handle attached to an exterior surface of the body.

10. The container of claim 1, wherein the interior bottom surface of the body is a bottom for each channel, over which fluid flows when being dispensed from the cavity and out the opening.

11. A container, said container comprising:

A conical-shaped body comprising a semi-cylindrical portion extending from a wider end to a tapered end, and a bottom portion extending from the wider opening end toward the tapered end of the semi-cylindrical portion, the semi-cylindrical portion joined with the bottom portion to define a fluid tight vessel having a hollow interior, the body having an opening at the wider end of the semi-cylindrical portion and an opposite, closed end, at a location where the tapered end of the semi-cylindrical portion and the bottom portion meet forming a base of the conical-shaped body and to thereby define a cavity for holding a liquid; and a plurality of substantially parallel fins extending upward from an interior surface of the bottom portion, the fins extending longitudinally from the opening toward the closed end of the body, defining substantially parallel channels extending from the opening toward the closed end of the body, each fin being disposed parallel to a flow of fluid when a fluid is dispensed from the fluid tight vessel and out the opening, wherein when a fluid is dispensed from the opening of the body, the fluid is dispersed evenly across the opening in a coaxial direction to the fins.

12. The container of claim 11, wherein the fluid is dispensed from the opening with minimal lateral dispersion relative the longitudinal direction of the fins.

13. The container of claim 11, the bottom interior surface is concave.

14. The container of claim 11, wherein the fins extend substantially along an entire length of the interior surface of the bottom portion of the body from the opening to the base.

15. The container of claim 11, further comprises a lip portion extending from a portion of the opening of the body, adjacent the bottom interior, the lip portion formed from an elastomeric or rubber material.

16. The container of claim 15, wherein the elastomeric or rubber material is softer than the material which composes the body.

17. The container of claim 11, further comprising a handle attached to an exterior surface of the body.

18. The container of claim 17, wherein the handle is attached to an exterior surface of the semi-circular portion proximate the tapered end.

19. The container of claim 11, wherein the fins extend gradually upward from the bottom surface at tapered end of the fins proximate the opening of the body.

* * * * *